US008201345B2

(12) United States Patent
Dalton et al.

(10) Patent No.: US 8,201,345 B2
(45) Date of Patent: Jun. 19, 2012

(54) METHOD FOR OPERATING A CLEANOUT CYCLE IN A DISPENSING DRYER

(75) Inventors: Michael T. Dalton, Saint Joseph, MI (US); Kaustav Ghosh, Saint Joseph, MI (US); Karl D. McAllister, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 424 days.

(21) Appl. No.: 12/489,529

(22) Filed: Jun. 23, 2009

(65) Prior Publication Data

US 2010/0000114 A1 Jan. 7, 2010

Related U.S. Application Data

(60) Provisional application No. 61/077,509, filed on Jul. 2, 2008.

(51) Int. Cl.
*F26B 7/00* (2006.01)

(52) U.S. Cl. ..... 34/389; 34/427; 34/480; 68/12.08; 68/12.09

(58) Field of Classification Search ..... 34/380, 34/381, 389, 427, 480, 524, 601, 90; 68/12.08, 68/12.09

See application file for complete search history.

(56) References Cited

U.S. PATENT DOCUMENTS

| | | | | |
|---|---|---|---|---|
| 3,085,415 | A * | 4/1963 | Gosnell | 68/12.08 |
| 3,206,950 | A * | 9/1965 | Xeros | 68/12.09 |
| 3,730,682 | A | 5/1973 | Brubaker et al. | |
| 3,848,436 | A | 11/1974 | Rottering | |
| 3,848,437 | A | 11/1974 | Rottering | |
| 4,941,270 | A | 7/1990 | Hoffman | |
| 7,168,274 | B2 | 1/2007 | Slutsky et al. | |
| 7,325,330 | B2 | 2/2008 | Kim et al. | |
| 2009/0272004 | A1 * | 11/2009 | Chernetski et al. | 34/389 |
| 2010/0000114 | A1 * | 1/2010 | Dalton et al. | 34/389 |
| 2010/0000264 | A1 * | 1/2010 | Luckman et al. | 68/4 |

* cited by examiner

*Primary Examiner* — Stephen M. Gravini
(74) *Attorney, Agent, or Firm* — Clifton G. Green; McGarry Bair PC

(57) ABSTRACT

A method for operating a cleanout cycle to remove treating chemistry dispensed within a dispenser dryer.

41 Claims, 8 Drawing Sheets

METHOD FOR OPERATING A CLEANOUT CYCLE IN A DISPENSING DRYER

CROSS-REFERENCE TO RELATED APPLICATIONS

This application claims priority from U.S. Provisional Application No. 61/077,509 filed on Jul. 2, 2008, entitled A METHOD FOR OPERATING A CLEANOUT CYCLE IN A DISPENSING DRYER hereby incorporated by reference.

BACKGROUND OF THE INVENTION

Dispensing dryers, while known, are still an uncommon type of clothes dryer, which dispense a treating chemistry onto a load of laundry during a drying cycle of operation. The treating chemistry may be any chemistry applied to the laundry such as water, bleach, perfume, softener, stain guard, anti-wrinkling, whitening, color guard or the like. Spraying may be used to deliver the treating chemistry from a dispensing system to the drying chamber.

SUMMARY OF THE INVENTION

The invention relates to a method for operating a cleanout cycle to remove treating chemistry in a dispenser dryer.

DESCRIPTION OF THE PREFERRED EMBODIMENT

Figure 1:
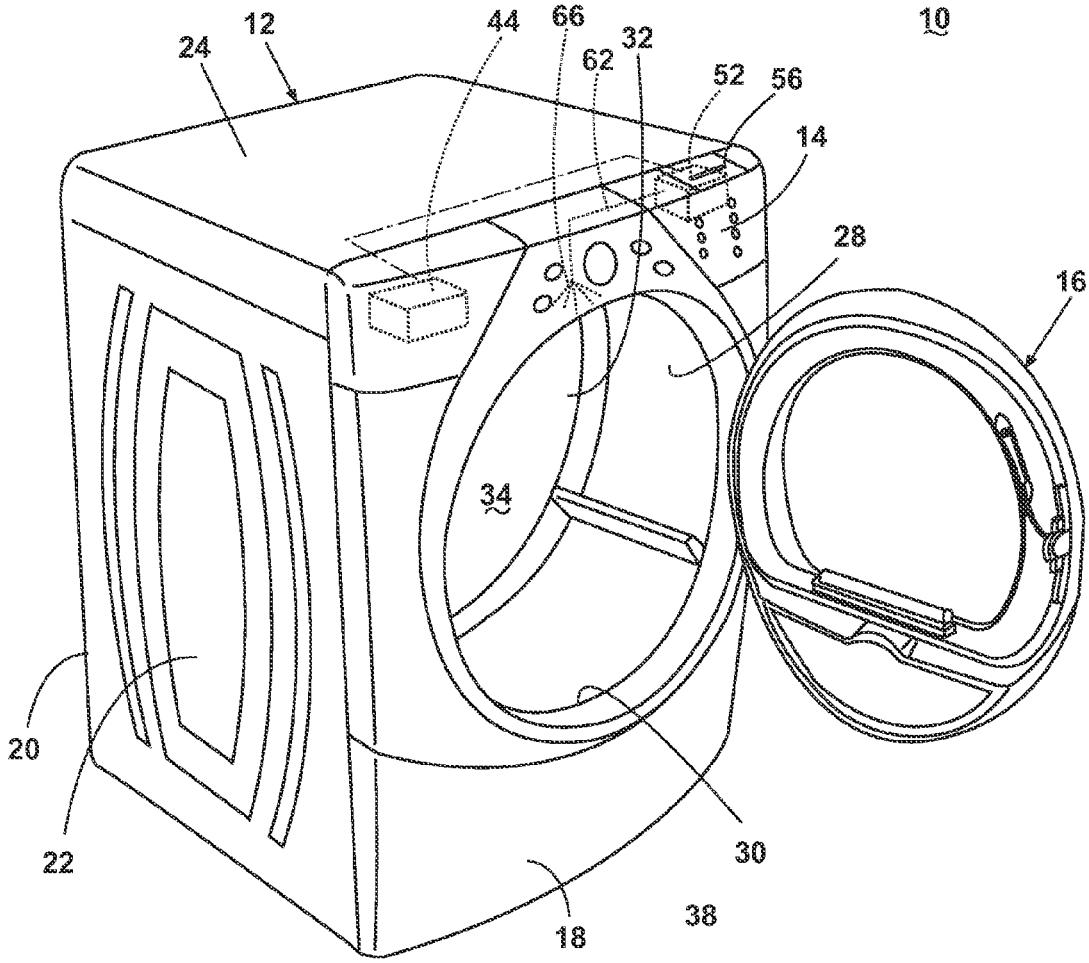
FIG. 1 is a front perspective view of a dryer having its operation controlled by the method according to the invention.

Referring to FIG. 1, an embodiment of a dispensing dryer 10 according to the invention may be illustrated comprising a cabinet 12 carrying a control panel 14 for controlling the operation of the dispensing dryer 10. The control panel 14 may have any number of features common to a control panel 14, including but not limited to a power button, dryer status indicator lights, parameter adjusting buttons and dials, a display, and start and stop buttons. These features may be marked with appropriate indicia to indicate their function. Selecting the cycle of operation may require a user to manipulate several of these features to initiate operation and specify common cycle parameters. Examples of such parameters include, but are not limited to cycle type, treatment type, heat level, dryness level, air level, temperature, and cycle length.

Typically, the dispensing dryer 10 will offer the user a number of pre-programmed cycles of operation to choose from, and each pre-programmed cycle of operation may have any number of adjustable parameters. The cycle of operation may be a treating cycle, a drying cycle, a combination treating and drying cycle, or any other cycle of operation provided by the dispensing dryer 10. Throughout the cycle of operation, the operational status of the dispensing dryer 10 may be reflected on the control panel 14 so as to visually inform the user of the status of the dispensing dryer 10, or to request that the user interact with the dispensing dryer 10.

The cabinet may be defined by a front wall 18, a rear wall 20, and a pair of side walls 22 supporting a top wall 24. A door 16 is hingedly mounted to the front wall 18 and is selectively moveable between opened and closed positions to close an opening in the front wall 18, which provides access to the interior of the cabinet 12.

The dispensing dryer 10 described herein shares many features of a traditional automatic clothes dryer, and will not be described in detail except as necessary for a complete understanding of the invention. Although the dispensing dryer 10 may be illustrated as a front-loading dryer, the dispensing dryer may also be a top-loading dryer, as well as a combination washing machine and dryer; a tumbling or stationary refreshing/revitalizing machine; an extractor; a non-aqueous washing apparatus; and a revitalizing machine.

A rotatable drum 28 is disposed within the interior of the cabinet 12 between opposing rear and front panels 30 and 32, which collectively define a drying chamber 34 for drying laundry. Examples of laundry include, but are not limited to, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be dried in the dispensing dryer 10.

The drum 28 may be a rotatable cylinder having rear and front edges that may be received within sealed channels of the rear and front panels 30, 32. The front panel 32 may have an opening that aligns with the open face of the front wall 18. The drum 28 may have a circumference larger than that of the door 16 such that part of the front wall 18 covers a portion of the front face of the drum 28. Thus, when the door 16 may be in a closed position it closes the face of the cabinet 12 and not the entire face of the drum 28. However, the drum 28 may be considered to be closed when the door 16 is in the closed position.

Figure 2:
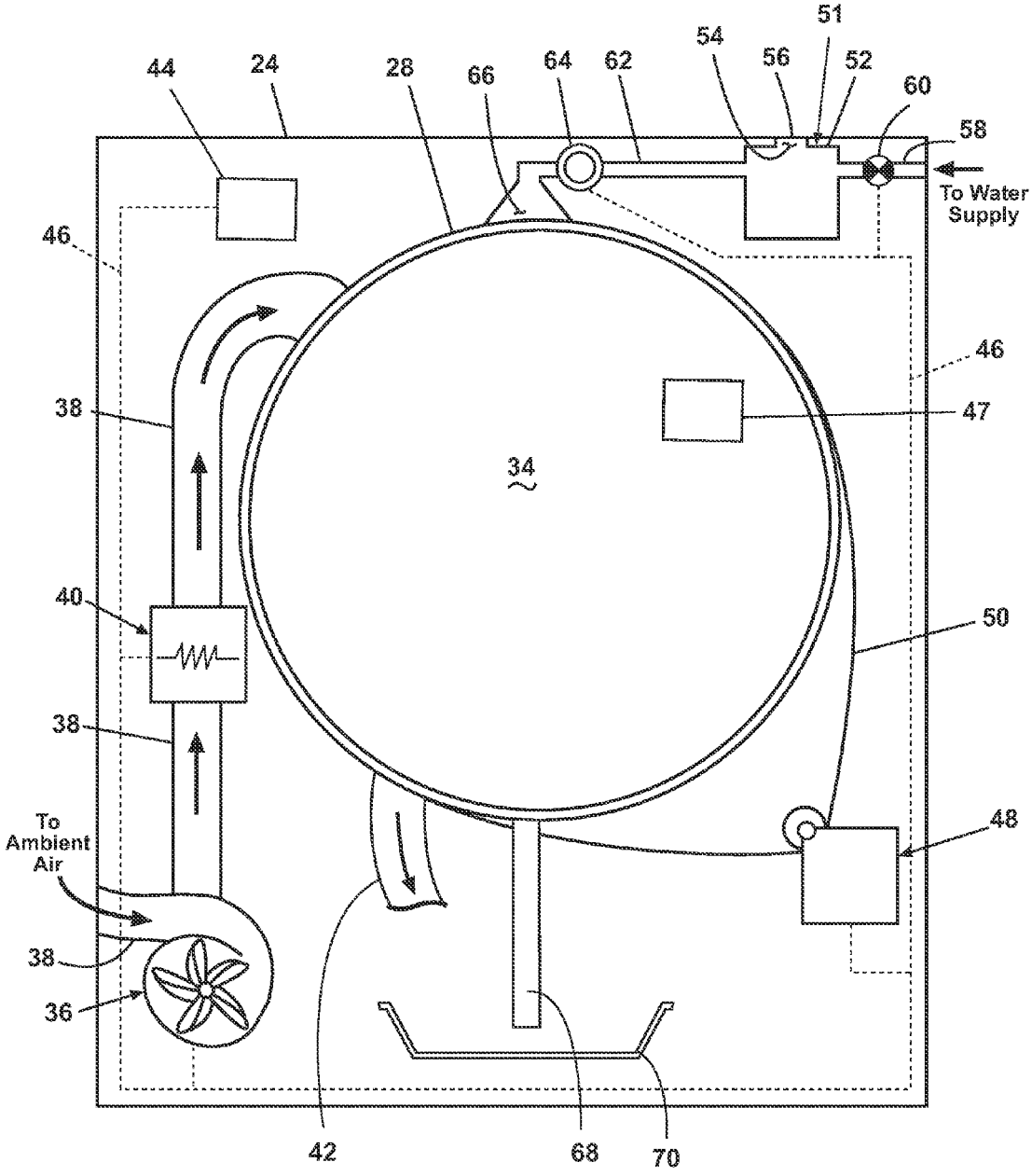
FIG. 2 is a schematic view of a first exemplary dryer having its operation controlled by the method according to the invention.

Referring now to FIG. 2, an airflow system includes a blower 36, an inlet conduit 38, and a heater assembly 40 in fluid connection with one another and the drying chamber 34. The inlet conduit 38 fluidly connects the ambient air with the drying chamber 34. The blower 36 and heater assembly 40 are located in-line with the inlet conduit 38. Ambient air may be drawn in through the inlet conduit 38 by the blower 36 and directed through the heater assembly 40, where the air is heated, if the heater assembly 40 is turned on, and then sent into the drying chamber 34. The airflow system also includes an exhaust conduit 42 that fluidly couples the drying chamber 34 to a standard exhaust fitting. Typically, the inlet conduit 38 may couple to a rear wall of the drying chamber 34 and the exhaust conduit may couple to a front wall of the drying chamber 34 and extend out the rear of the cabinet 12. However, other flow paths are possible as well as other arrangements of the blower 36 and heater assembly 40. For example, the blower assembly may be located in the exhaust conduit 42.

Both the heater assembly 40 and the blower 36 may be connected to a controller 44 by various control leads 46. The controller 44 may be capable of receiving and processing signals from a sensor 47 for controlling the operation of the dispensing dryer 10, such as the duration of a drying cycle, according to preprogrammed instructions and/or algorithms, some of which may be determined by user-selected inputs into the control panel 14. The controller 44 may comprise a well-known control device, such as a microprocessor, digital memory for storing digital data obtained from the output of the sensor 47 and interfaces for suitable communication devices, such as the control panel 14.

FIG. 2 also illustrates that the rotatable drum 28 may be driven in a traditional manner by a motor 48 and an endless drive belt 50 coupling the drum 28 with the motor 48. The motor 48 rotates the drum 28, which may be adapted to hold a load of laundry for drying, through the endless drive belt 50. The controller 44 operably couples the motor 48 and may cause the drum to rotate in a forward direction or a reverse direction during an operating cycle. During an operating cycle, the controller 44 may also operate the drum 28 to rotate either in first one direction and then a second direction, or to stop the drum from rotating and start it rotating again in either the same or opposite direction.

The sensor 47 may be a moisture sensor, such as a conductivity strip, or the sensor 47 may be a temperature sensor, such as a thermistor. The sensor 47 may be coupled to the rear wall of the drying chamber 34 by any suitable means. Alternatively, the sensor 47 may be mounted at any location in the interior of the dispensing dryer 10 such that the sensor 47 may be able to accurately sense the moisture content or temperature of the laundry, respectively. Additional sensors may be used in the dispensing dryer 10. Examples of additional sensors include, without limitation, a temperature sensor and a flow rate sensor. The sensor 47 may be operably coupled to the controller 44 such that the controller 44 receives output from the sensor 47.

The dispensing dryer 10 may also have a dispensing system 51, which may include a reservoir 52, a reservoir opening 54 located near the control panel 14 and selectively closed by a lid 56. The lid 56 may provide access to the reservoir 52 through the reservoir opening 54. The lid 56 may be any type of lid 56 enabling movement between an opened position and a closed position uncovering and covering the reservoir opening 54, respectively. The lid 56 may be normally kept in the closed position covering the reservoir opening 54 to prevent the entrance of undesirable objects into the reservoir 52. Thus, the lid 56 provides access to the reservoir 52 from the exterior of the cabinet 12 such that a user may fill the reservoir 52 when necessary. The desired chemistry may be poured or otherwise manually deposited through the reservoir opening 54 and into the reservoir 52. The reservoir 52 may include a chemistry level detector (not shown) that may be used to detect a level of chemistry in the reservoir 52.

The dispensing system 51 may have a chemistry supply line 62 fluidly coupling the reservoir 52 and the drying chamber 34 and having a chemistry meter mounted thereon, and a dispenser 66. Chemistry may be delivered to the dispenser 66 via the chemistry supply line 62 from the reservoir 52. Then the dispenser 66 may dispense the chemistry into the drum 28. The chemistry meter, illustrated as a pump 64, may electronically couple, wired or wirelessly, to the controller 44 to control the amount of chemistry dispensed. The pump 64 may be provided inline of the chemistry supply line 62 to control the dispensing of the treating chemistry from the reservoir 52. The pump 64 may be operably coupled to the controller 15 such that the controller 15 may control the dispensing of the treating chemistry by the actuation of the pump 64. The pump 64 may fluidly couple the reservoir 52 to the chemistry supply line 62 to establish a metered flow path from the reservoir 52 to the drum 28.

Although the reservoir 52 may be illustrated as being a manual top-fill reservoir 52, the reservoir 52 may be any type of reservoir 52 configured to hold a chemistry to be dispensed into the drying chamber 34. For example, the reservoir 52 could be a drawer-type reservoir that may be pulled outwardly from the cabinet 12 to be filled. The reservoir 52 may also be inaccessible to the user and filled with chemistry by chemistry supply lines (not shown) fluidly connected thereto. The reservoir 52 may be able to receive a cartridge containing a chemistry to be dispensed. It may be contemplated that the cartridge may include an integrated metering device that electronically couples, wired or wirelessly, to the controller 44 to control the amount of chemistry dispensed.

An optional water supply line 58 fluidly coupled to the reservoir 52 and having a water supply valve 60 mounted thereon. The reservoir 52 may be supplied with water via the water supply line 58. Water may or may not be supplied to the reservoir 52 depending on the specific cycle of operation being carried out by the dispensing dryer 10. The amount of water supplied to the reservoir 52 may be regulated by the water supply valve 60, which may be operated by the controller 44. The controller 44 may operate the water supply valve 60 based on the level of chemistry detected by the chemistry level detector. Alternatively, the controller 44 may operate the water supply valve 60 to supply a predetermined amount of water to the reservoir 52. The water supply line 58 may be connected to a water supply such as a home water supply line.

The dispenser 66 may be a rigid nozzle or may be a flexible nozzle constructed of a material such as silicone, or polyethylene. It may be readily understood that the type of dispenser and the number of dispensers may be changed. For example, there may be any number of nozzles positioned to direct the chemistry into the drying chamber 34. Furthermore, the dispenser 66 may be movable to provide improved coverage of the inner surface of the drum 28. In addition to nozzles, other types of dispensers may be used, such as misters, nebulizers, steamers, or any other outlet that produces a spray. The dispenser 66 may dispense the chemistry as a continuous stream, a mist, an intermittent stream, or various other spray patterns.

The dispenser 66 may be positioned adjacent to an access opening of the drum and may be directed upwardly at the inner surface of the drum 28. Alternatively, the dispenser 66 may be mounted on the back of the drum. It may be readily understood that the position of the dispenser 66 may be changed as long as the dispenser 66 may be able to direct the chemistry at the inner surface of the drum 28 so that laundry may contact and absorb the chemistry, or so that the dispenser 66 may dispensing the chemistry directly onto the laundry in the drying chamber 34. For example, the dispenser may provide a directed spray at the drum surface using a first pressure or a mist spray that disperses the chemistry into the drum using a second pressure.

The chemistry when dispensed by the dispenser 66 may form a band of droplets, covering the inner surface of the drum. Once the band of droplets may have been formed, the laundry falls against these droplets and absorb them from the inner surface of the drum. However, not all of the droplets may be absorbed and residue may be left on the drum 28. Additionally, chemistry dispensed into the drum 28, and not absorbed by the laundry or left on the drum 28, may run out of the drum 28 due to gravity or may be spun from the drum 28 by centrifugal force as the drum 28 may be spun. According to the embodiment illustrated in FIG. 2, a drain channel 68 may fluidly couple the drying chamber 34 to a drain pan 70. Chemistry dispensed may collect in the drain channel 68 where it may then flow to the drain pan 70. The drain pan 70 may be accessed exteriorly of the dispensing dryer 10 by the user and may be periodically emptied.

Figure 3:
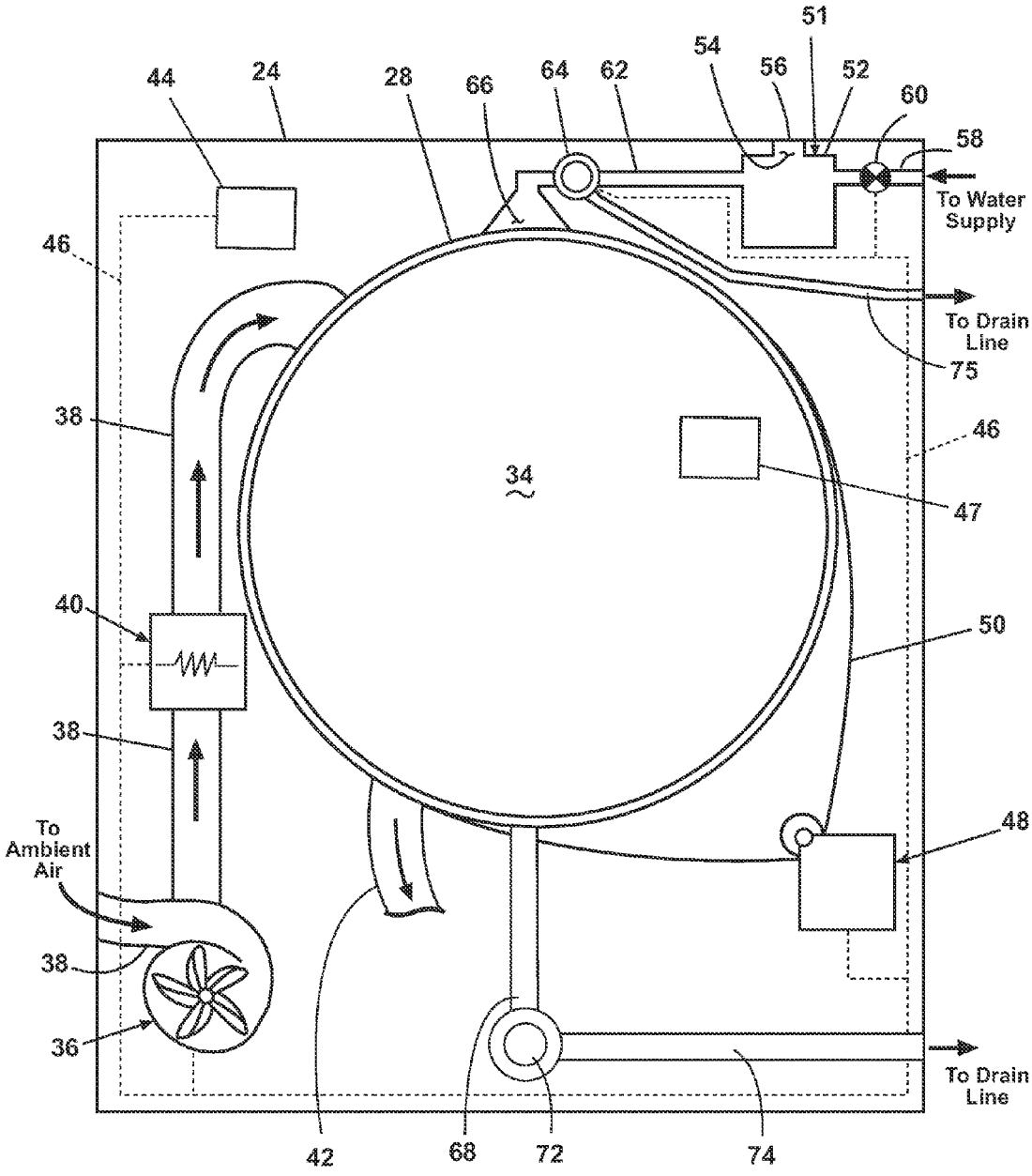
FIG. 3 is a schematic view of a second exemplary dryer having its operation controlled by the method according to the invention.

In a second embodiment illustrated in FIG. 3, a drain pump 72 replaces the drain pan 70 of the first embodiment. Thus, the drain channel 68 may fluidly couple to the drain pump 72, which has an outlet fluidly coupled to a drain pump outlet conduit 74 coupled to a household drain. Excess chemistry dispensed will be channelled from the drum 28 through the drain channel 68 and pumped by the drain pump 72 out of the dispensing dryer 10 to the drain pump outlet conduit 74 for connection to a drain line in a home plumbing system (not shown) for disposing of the chemistry. With this configuration, the user need not worry about emptying or cleaning the drain pan 70 as the drain pump 72 automatically drains away any excess fluid. FIG. 3 further illustrates an optional second drain conduit 75 that is fluidly coupled to the pump 64. Thus, pump 64 has two outlets that the controller 44 may operate the pump 64 to switch between depending on whether it is desired that liquid be disposed of or sent to the drying chamber 34.

Figure 4:
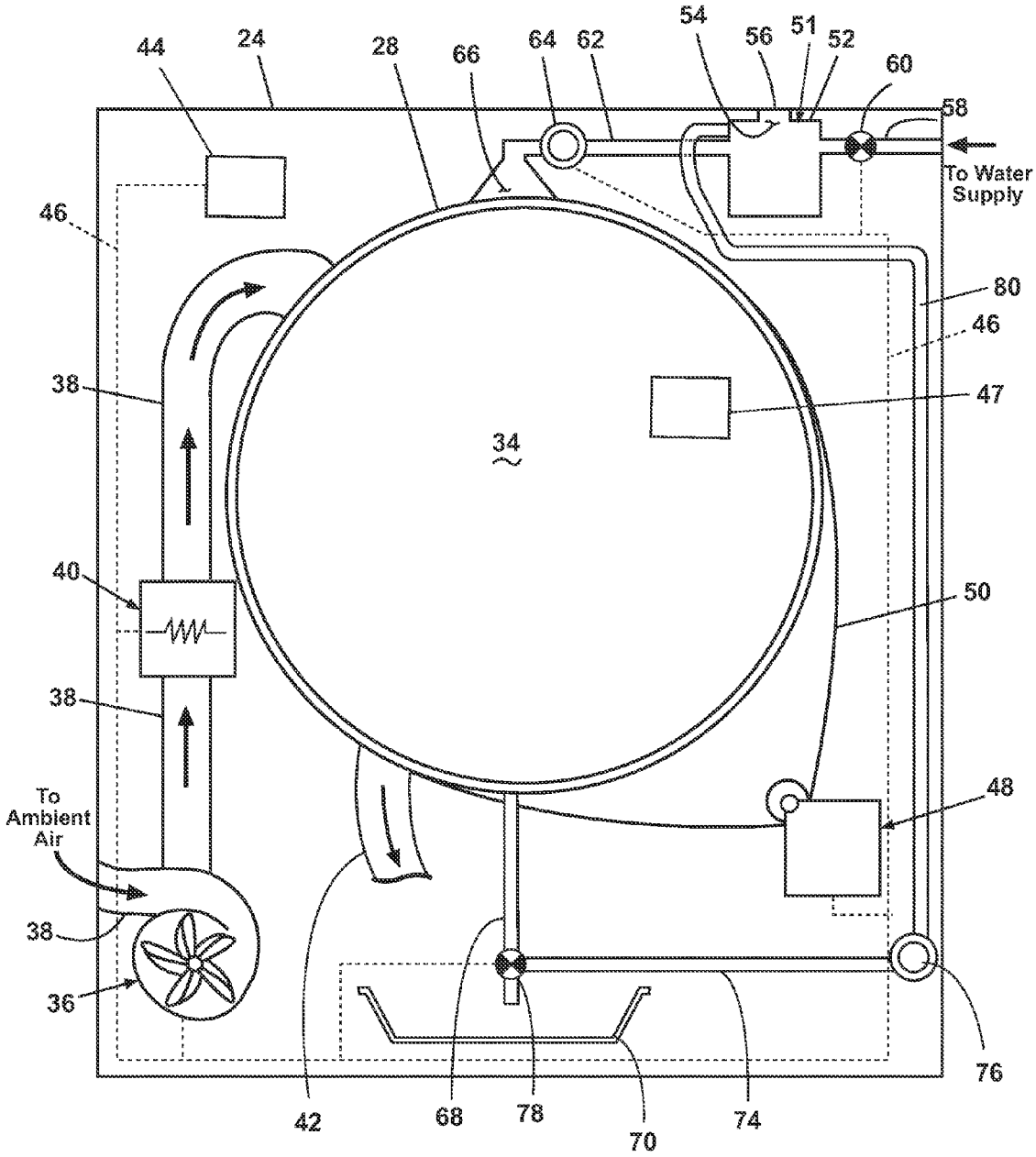
FIG. 4 is a schematic view of a third exemplary dryer having its operation controlled by the method according to the invention.

In a third embodiment illustrated in FIG. 4, the drain channel 68 may fluidly couple to either the drain pan 70 or to a recirculation pump 76 through a drain valve 78. The recirculation pump 76 may fluidly couple the drain channel 68 to the reservoir 52 through a recirculation conduit 80 to form a recirculation loop. The drain valve 78, operably coupled with the controller 44, may selectively fluidly couple the drain channel 68 with either the drain pan 70 or the recirculation pump 76 depending on whether reuse or disposal of the excess chemistry is desired. In operation, excess chemistry dispensed will be channeled from the drum 28 through the drain channel 68 and through the drain valve 78, to be either pumped by the recirculation pump 76 into the reservoir 52 for reuse of the excess chemistry or to the drain pan 70 for disposing of the chemistry. The drain pump 72 of the second embodiment may replace the drain pan 70. Also, the recirculation pump 76 may have two outlets and may be used in place of the drain valve 78. One of the outlets is coupled to the recirculation conduit 80 and the other outlet is coupled to a drain line as illustrated in the second embodiment.

It may be understood, that the drainage systems illustrated in FIGS. 2-4 may have additional valves and conduits associated with them. Additionally, the embodiment illustrated in FIG. 4 may have a drain pump system for disposal of the excess chemistry instead of the drain pan 70.

Generally, in normal operation of the dispensing dryer 10, a user first selects an appropriate cycle of operation by means of the control panel 14. In accordance with the user-selected parameters input at the control panel 14, the controller 44 may control the operation of the rotatable drum 28, the blower 36, the heater assembly 40, and the dispensing system 51, to implement a drying cycle or treating cycle stored in the controller 44 to dry or treat the laundry before a user takes the laundry out of the dispensing dryer 10 and a clean-out cycle may be executed.

When appropriate, the motor 48 rotates the drum 28 via the endless drive belt 50. The blower 36 draws air out of the drying chamber 34 and into the inlet conduit 38, as illustrated by the flow vectors. The blower 36 then circulates the air through the heater assembly 40 to heat the air. The heated air may then be propelled through the inlet conduit 38 and into the drying chamber 34. Air may be vented through the exhaust to remove moisture from the drying chamber 34. This cycle continues according the selected parameters. The motor 48, blower 36, and heater assembly 40 may operate independently during the cycle of operation.

Treating chemistry may be dispensed into the drying chamber 34 during a drying cycle or treating cycle. During either cycle output generated by the sensor 47, as well as output generated by additional sensors, may be utilized to generate digital data corresponding to sensed operational conditions inside the drying chamber 34. The sensors could determine the moisture content of the laundry present in the drying chamber 34, or the temperature of the laundry present in the drying chamber 34. The output may be sent to the controller 44 for use in calculating operational conditions inside the drying chamber 34, or the output may be indicative of the operational condition. Once the output is received, the controller 44 processes the output for storage in the memory. The controller 44 may convert the output during processing such that it may be properly stored in the digital memory as digital data. The stored digital data may be processed in a buffer memory, and used, along with pre-selected coefficients, in algorithms to electronically calculate various operational conditions, such as a degree of wetness of the laundry and a temperature of the laundry. The degree of wetness and the temperature of the laundry are designated as dispensing operational conditions because they are typically associated with the operation of the dispensing system 51, although the degree of wetness and the temperature of the laundry may also be associated with other components of the dispensing dryer 10. The controller 44 may use both the parameters specified by the user and the additional information obtained by the sensor 47, or additional sensors, to carry out the desired drying cycle.

Figure 5:
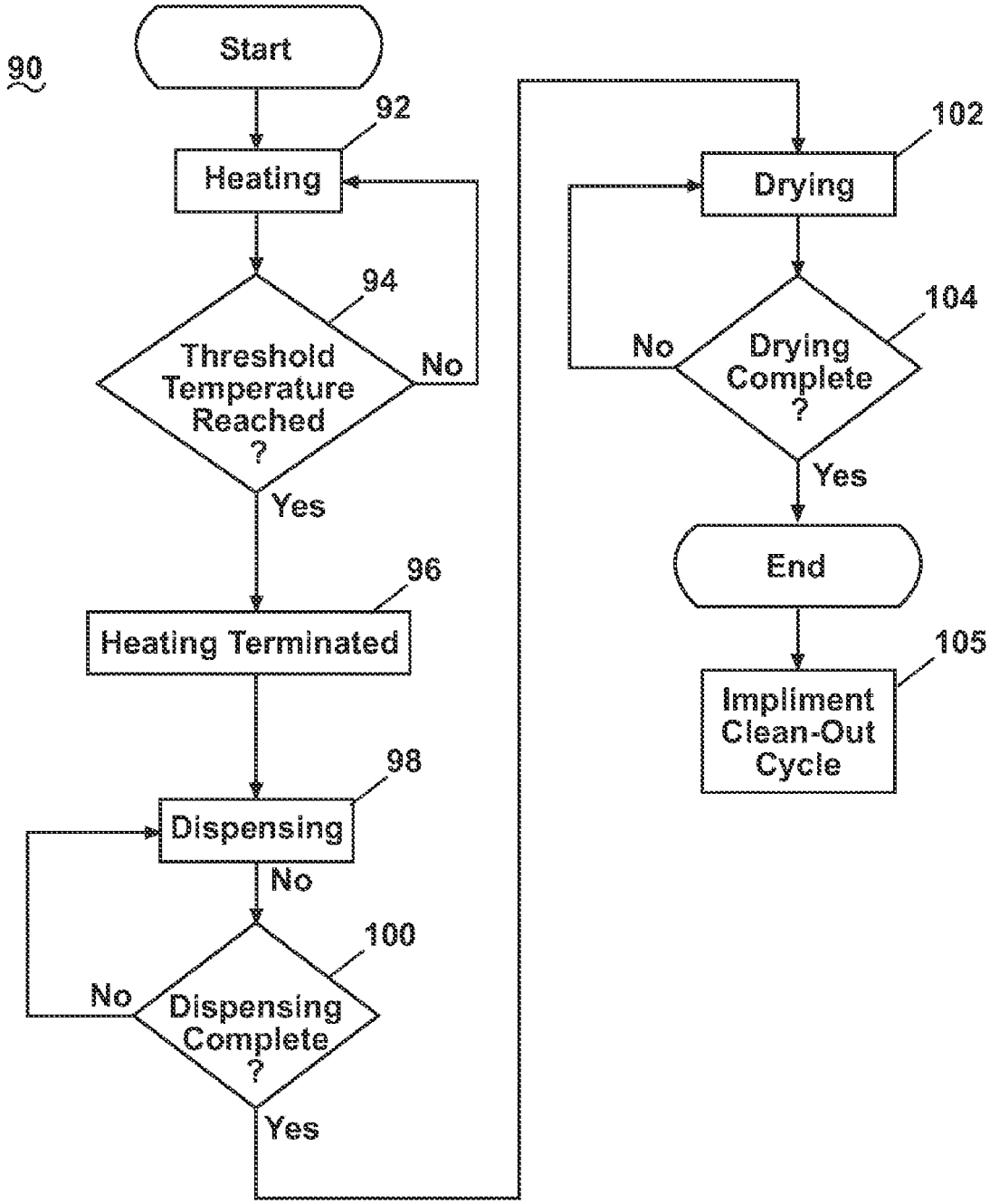
FIG. 5 is a flow chart illustrating an exemplary drying cycle of operation to be carried out by any of the dispensing dryers of FIGS. 1-4.

More specific operation cycles will now be described based on an overall operation of a drying cycle where the dispensing dryer 10 is operated to dispense a treating chemistry into the drying chamber 34 to treat the laundry. FIG. 5 illustrates an exemplary cycle of operation that will set the conditions for which a clean-out cycle of the invention may be applied. The application of the clean-out cycle may occur before, during or after the cycle of operation. Exemplary clean-out cycles are illustrated in FIGS. 6-10.

FIG. 5 illustrates an exemplary drying cycle 90 in which treating chemistry is dispensed as part of an overall drying cycle 90. The drying cycle 90 may begin with a heating step 92 during which heat is applied to the laundry in the drying chamber 34. More specifically, heat is applied by supplying power to the heater assembly 40 and the blower 36. During the heating step 92, the laundry may be tumbled to promote even distribution of the heat.

Heating step 92 is an optional preheat step and is used to prepare the laundry for the treating chemistry. Many of the treating chemistries may be activated, or their efficacy increased, at a certain temperature. Thus, the method may continue with a determination at a step 94 of whether a threshold temperature, in this example the temperature at which a treating chemistry to be dispensed activates, has been reached based on the output of the sensor 47.

In step 94, the controller 44 compares sensed and/or calculated heating conditions to desired heating conditions correlating to the activation temperature for the treating chemistry being dispensed. If the sensed heating conditions at step 94 meet the desired conditions for dispensing, the controller 44 determines that the heating step 92 is complete and the power to the heater assembly 40 and the power to the blower 36 are terminated in step 96. If the sensed heating conditions do not meet the desired conditions for dispensing then the heating step 92 is not complete and the controller 44 will continue to heat the laundry until the desired conditions are met. The desired dispensing conditions may be empirically determined for each treating chemistry to be dispensed.

Upon termination of the heating in step 96, a dispensing step 98 begins. During the dispensing step 98, the dispensing system 51, operated by the controller 44, may spray the treating chemistry into the drying chamber 34, where it is applied to the laundry. The controller 44 operates the pump 64 based on the output received from the sensor 47. Based on the output, the controller 44 may be able to determine if too little or too much chemistry may have been dispensed to a particular load of laundry being treated in the drying chamber 34. The laundry may also be tumbled, heated, or otherwise treated during the dispensing step 98. Preferably, during the dispensing step the drum 28 rotates thereby tumbling the laundry within the drum 28 and promoting even distribution of the treating chemistry. The tumbling may be continuous or in multiple segments. The tumbling may also be one or multiple rotational directions, or alternate between the multiple rotational directions. The rotational direction of rotation may be the same for each segment or may be varied for each segment. The speed of rotation may be constant or varied for the entire tumbling or on a segment-by-segment basis.

At step 100, the controller 44 may make a determination as to whether or not the dispensing step 98 may be complete. The controller 44 may take into consideration the degree of wetness of the laundry in the drying chamber 34 or the temperature of the laundry in the drying chamber 34, when it determines how much treating chemistry to dispense and at what intervals the treating chemistry should be dispensed. Completion of the dispensing step 98 may be determined by comparing calculated dispensing conditions to desired dispensing conditions that indicate completion of the dispensing step 98, such as a certain volume of treating chemistry dispensed or a certain length of time during which the treating chemistry was dispensed. If the dispensing step 98 is not complete, the controller 44 will continue to operate the dispensing system 51 and/or the other components of the dispensing dryer 10 until the desired amount of treating chemistry has been dispensed.

During the dispensing step 98, the airflow system may be on or off. Whether the airflow system is on will depend on the type of treating chemistry. The heating system may also be on or off depending on the type of treating chemistry.

When the appropriate amount of treating chemistry has been dispensed, a drying step 102 may begin. The drying step 102 may be used to dehydrate the laundry using heat from the heater assembly 40 and air from the blower 36. During the drying step 102, the laundry may also be tumbled. Completion of the drying step 102 may be determined in step 104 where the controller 44 compares sensed or calculated drying conditions to desired drying conditions that would indicate completion of the drying step 102. Desired drying conditions may correlate to a specific temperature or degree of wetness of the laundry that has been empirically determined to correlate to dry laundry. If the drying step 102 is not complete, the controller 44 will continue to operate the heater assembly 40 and the blower 36 until the desired conditions are met. The drying cycle ends after completion of the drying step 102.

At this point, depending upon the inputs entered into the control panel 14 by the user a cool-down step may begin where the temperature of the laundry may be reduced. During the cool-down step, the blower 36 is activated to move air through the drying chamber 34 and the laundry may be tumbled. Alternatively, the user may input additional controls into the control panel 14 and the dispensing dryer 10 may undertake additional drying or the user may remove the laundry from the drying chamber 34. Once the laundry is removed from the drying chamber and the door 16 is positioned in the closed position, the dispensing dryer 10 may execute a clean-out cycle 105 to remove residual treating chemistry buildup from the dispensing dryer 10. Such clean-out cycles will be discussed in detail below.

In the cycle described above in FIG. 5, the dispensing step 98 was illustrated to be implemented as a part of the drying cycle 90; however, the dispensing step may be dispensed as a part of a treating cycle separate from the drying cycle. According to this second method of operation a treating cycle, wherein treating chemistry may be dispensed into the drying chamber 34, may be followed by a separate drying cycle after which laundry may be removed from the dispensing dryer 10 and a clean-out cycle may be executed to remove treating chemistry from the dispensing dryer 10.

It should be noted that multiple dispensing steps may occur during a drying cycle. After each of the multiple dispensing steps occurs a separate drying step may occur. Furthermore, as the chemistries dispensed in each of the dispensing steps may be deleterious to another chemistry's efficacy a clean-out cycle may be completed after the dispensing of each of the chemistries. Alternatively, multiple dispensing steps may occur followed by a single drying step.

After the drying cycle, either including the dispensing step as illustrated in FIG. 5 or without, is completed and after the user has removed the laundry from the drying chamber 34 and the door 16 is placed in the closed position the dispensing dryer 10 may determine which clean-out cycle to execute. The clean-out cycle to be executed may be selected by the user and input through the control panel. Alternatively, the clean-out cycle to be executed may be determined by the controller 44 based upon a determination by the controller 44 of at least one previously dispensed treating chemistry or at least one previously executed drying cycle. The appropriate clean-out cycle to be implemented depends on the treating chemistries previously dispensed into the drying chamber 34. A plurality of clean-out cycles may be stored in the controller 44. The purpose of the clean-out cycle may be to remove the treating chemistry previously dispensed from the dispensing system 51, drying chamber 34, or other aspects of the dispensing dryer 10.

According to the invention, executing the clean-out cycle may include any one or combination of flowing air through the drying chamber, heating the drying chamber, rotating the drying chamber, dispensing clean-out chemistry into the drying chamber, or wiping the drying chamber. The following paragraphs will generally describe some characteristics of a clean-out cycle.

Regardless of the clean-out cycle to be implemented and thus, regardless of the type of residual treating chemistry to remove, it may be preferable at the beginning of the clean-out cycle to operate the blower 36 to dislodge any lint or other particulates in the conduits and drying chamber 34. It may be preferred that the air be flowed at the maximum flow rate allowed by the blower 36. The highest airflow rate helps to dislodge the dried treating chemistry flakes from the surfaces of the dispensing dryer 10. The lint or particulates may contain residual treating chemistry or be formed of residual treating chemistry. The removal of the lint or particulates by the flowing of air may help prevent any subsequent clean-out chemistry from soaking into or nucleating with the residual treating chemistry. The flowing of air may be the first step in any of the specific clean-out cycles described below.

If the clean-out cycle to be implemented calls for a clean-out chemistry to be dispensed during the clean-out cycle, the clean-out chemistry may be placed into the reservoir 52 and dispensed in the same manner as previously described for the treating chemistry. The clean-out chemistry may be water that may be supplied to the drying chamber 34 and dispensing system 51 from the water supply line 58. When the clean-out chemistry is dispensed from the dispensing system 51 to the dispensing chamber, it may form a mixture of clean-out chemistry and the residual treating chemistry.

The clean-out cycle may include heating the drying chamber 34, which is useful when the clean-out chemistry may be activated at certain functional temperature ranges. Thus, the drying chamber 34 may be heated to a functional temperature for the clean-out chemistry.

At the end of the clean-out cycle, the mixture may be removed from the drying chamber 34 to ensure the remaining mixture does not negatively impact the efficacy of a subsequent treating chemistry. As an alternative to removal, the mixture may be rendered inert, such as by heating the drying chamber 34 a sufficient amount to destroy the active ingredients of the mixture.

In the case of removal, the mixture may be removed manually by the user or automatically as part of the clean-out cycle. For a manual removal, the user may wipe the mixture from the drying chamber 34. However, manual removal is less desirable than automatic removal as there is no guarantee that the user will perform the wiping or perform it properly.

In the case of automatic removal, the mixture may be removed by using an accessory inside the dispensing dryer 10 to wipe the inside of the drying chamber 34. The accessory may be a special load that tumbles inside the dispensing dryer 10 to wipe the inside of the drum 28 and promote better cleaning. The accessory may also be a cleaning sponge that may wipe residual chemistry from surfaces as it tumbles in the dispensing dryer 10. The cleaning sponge may be dry or soaked with an appropriate clean-out chemistry to help dissolve the buildup. Alternatively, the accessory may be a load of wet clean rags or towels. Alternatively, the accessory may be a wiping insert that attaches to a stationary surface inside the drum 28 where the insert may have been an arm with a brush that extends across the entire inner surface of the drum 28 and as the drum 28 rotates, the drum 28 slides across the insert, wiping itself clean. For any accessory that may be used the control panel 14 may instruct the user to put the accessory into the drum 28.

The removal may also include draining the mixture from the drying chamber 34. The mixture may be removed from the drying chamber 34 via the drain channel 68 and a drain pan 70 or the drain channel 68, drain pump 72, and drain pump outlet conduit 74. As a further alternative, the drying chamber 34 may be heated to evaporate the mixture and the airflow system may be operated to flow air through the drying chamber to remove the evaporated mixture.

The execution of any of the clean-out cycles may also include causing the drum 28 to be rotated in any manner of ways. The drum 28 may be rotated during any portion of the clean-out cycle including when clean-out chemistry is sprayed into the drying chamber 34. It may be rotated in any suitable manner such as a forward and reverse pattern or with durations during which the drum may be rotated and then stopped, rotated and then stopped.

Specific embodiments of the clean-out cycle will now be described. It should be noted that the following examples may further explain the various types of clean-out cycles and it may be understood that these are presented for illustration purposes only and are not in any way a limitation.

Figure 6:
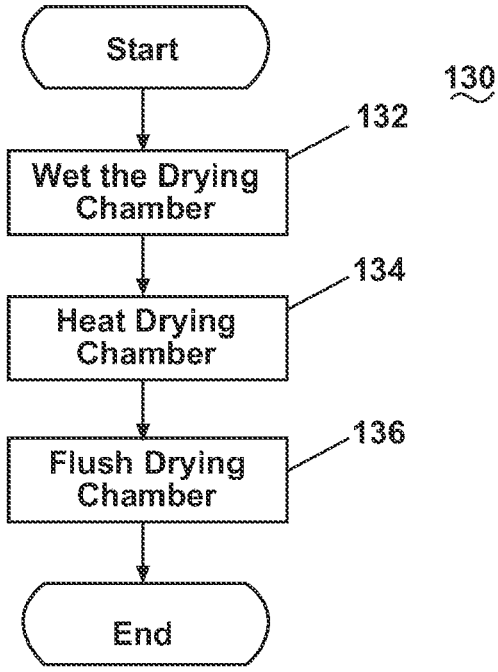
FIG. 6 is a flow chart illustrating an exemplary water only clean-out cycle of operation to be carried out by any of the dispensing dryers of FIGS. 1-4.

FIG. 6 illustrates an exemplary method for a water-only clean-out cycle 130. During the water-only clean-out cycle 130, water is the only clean-out chemistry to be dispensed. This method may be particularly useful when the residual treating chemistry buildup in the dispensing dryer 10 is water-soluble. The method for the water-only clean-out cycle 130 may be implemented in any suitable manner, such as an automatic cycle of the dispensing dryer 10 that continuously runs as long as the dispensing dryer 10 remains in operation. The method for the water-only clean-out cycle 130 begins with a wetting of the drying chamber 34 at wetting step 132 by dispensing of water from the dispensing system 51 to the drying chamber 34. The wetting of the drying chamber aids in dissolving the treating chemistry build-up into a solution with the water. The drum may be rotated during and/or after the dispensing to effect a more even distribution of water in the treating chamber. Thus, power may be provided to the motor 48 to enable the drum 28 to be rotated, the water supply valve 60 may be opened, and the pump 64 may be operated such that water may flow through the dispensing system 51 and be sprayed into the drying chamber 34.

The initial wetting step my occur without flowing air through the drying chamber 34 and without heating the drying chamber 34. The wetting step is intended to soften the residual treating chemistry buildup. The water entering the drying chamber 34 mixes with any residual treating chemistry buildup therein to form a mixture.

The length of the wetting step 132 may be empirically determined for each dispensing dryer 10 and may be the time to wet the entire drying chamber 34, approximately thirty seconds. When this empirical time is reached, the controller 44 may close the water supply valve 60 and stop operation of the pump 64.

After the wetting step 132, a heating step 134 is commenced where the drying chamber 34 is heated to a predetermined temperature. The heating of the drying chamber 34 heats any residual treating chemistry, which helps prepare the treating chemistry for dissolution into the water. The drum may be rotated during this heating step to more evenly heat the drying chamber. Thus, the controller 44 provides power to the blower 36 and the heater assembly 40. It should be noted that the initial spray and tumble period may be omitted in the water-only clean-out cycle 130.

The heating step 134 is stopped prior to the onset of evaporation, which is accomplished by heating only to 60° C. While other reference temperatures are acceptable, this temperature has been found to strike a good balance between encouraging dissolving while avoiding evaporation. If the mixture of water and residual treating chemistry evaporates, it increases the likelihood that the residual treating chemistry will redeposit once the vapor condenses. While it is possible to turn on the air flow system to remove any vapor, it has been found that the removal of the residual treating chemistry for water-soluble treating chemistries is more effective if vaporization does not occur. Once the threshold temperature has been reached, the heating step 134 is finished and the power to the heater assembly 40 and the blower 36 may be terminated.

Once the heating step 134 is complete, the drying chamber 34 is flushed at step 136 with water to remove the dissolved residue. The flushing step 136 is accomplished by dispensing water into the drying chamber 34 with a second water dispensing, which may be done with rotation of the drum 28. Again, once the water supply valve 60 is opened and pump 64 operated water may flow through the dispensing system 51 and be sprayed into the drying chamber 34 to be mixed with the mixture therein. This second introduction of water into the dispensing system 51 and drum 28 will more effectively flush the dispensing system 51 and drum 28.

Water may be dispensed in step 136 for a predetermined amount of time and that time may be empirically determined for each dispensing dryer 10 and may be the time for a second introduction of water into the drying chamber. When the threshold time has been reached, the controller 44 closes the water supply valve 60, stops operation of the pump 64, and terminates power to the motor 48 and the clean-out cycle terminates. The mixture then may be wiped from the inner drum surfaces by the user or an accessory, or the mixture may be drained via the drain channel 68 and a drain pan 70 or the drain channel 68, drain pump 72, and drain pump outlet conduit 74.

The initial wetting step 132 may be an optional step. Depending on the type of treating chemistry, it has been found that the heating step 134 followed by the flushing step 136 is sufficient to dissolve and remove the residue.

Figure 7:
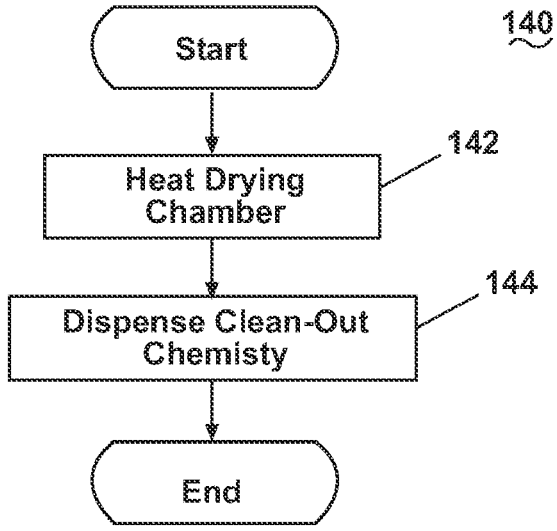
FIG. 7 is a flow chart illustrating an exemplary other chemistry clean-out cycle of operation to be carried out by any of the dispensing dryers of FIGS. 1-4.

FIG. 7 illustrates another exemplary method for a clean-out cycle, using a clean-out chemistry other than water, which will be referred to as chemistry clean-out cycle 140. This method may be particularly suited when the residual treating chemistry buildup in the dispensing dryer 10 is not water-soluble. The method for the chemistry clean-out cycle 140 may be implemented in any suitable manner, such as an automatic cycle of the dispensing dryer 10 that continuously runs as long as the dispensing dryer 10 remains in operation.

The method for the chemistry clean-out cycle 140 is very similar to the water-only clean-out cycle 130, without the initial wetting step. The chemistry clean-out cycle 140 begins with a heating step 142 where the drying chamber is heated. The heating step 142 may terminate upon reaching a reference temperature or may continue throughout the entire chemistry clean-out cycle 140. The drum may be rotated to more evenly heat the drying chamber 34.

The threshold temperature may be determined empirically and may differ for each clean-out chemistry to be dispensed. The threshold temperature desired may correlate to an activation temperature for each clean-out chemistry to be dispensed. If the threshold temperature has not been met, the heating step 142 is not complete and the controller 44 will continue to heat the dispensing dryer 10 until the threshold temperature is reached. If the threshold temperature has been met then the power to the heater assembly 40 and to the blower 36 may be terminated.

The chemistry clean-out cycle 140 may continue with a chemistry dispensing step 144 during which the non-water, clean-out chemistry is dispensed into the drying chamber 34. The dispensing is accomplished by operating the pump 64 to control the amount of chemistry dispensed to the chemistry supply line 62 and to the drying chamber 34. The drum may be rotated in any manner during the dispensing of the non-water clean-out chemistry.

The chemistry dispensing step 144 occurs until a desired amount of non-water clean-out chemistry has been dispensed. The desired amount may be a reference or threshold amount that is determined by the amount of time the non-water clean-out chemistry is dispensed or by a volume determination. Both the time and volume amounts may be empirically determined for each dispensing dryer 10 and non-water clean-out chemistry. For example, the appropriate amount may correlate to a specific time for the clean-out chemistry to be dispensed into the drying chamber. When the desired amount of non-water clean-out chemistry has been dispensed, the controller 44 stops dispensing the non-water clean-out chemistry and terminates power to the motor 48 and the chemistry clean-out cycle 140 terminates. The mixture then may be wiped from the inner drum surfaces by the user or an accessory, or the mixture may be drained via the drain channel 68 and a drain pan 70 or the drain channel 68, drain pump 72, and drain pump outlet conduit 74.

While the chemistry clean-out cycle 140 is described without the dispensing of water, a water dispensing step is optional and may follow the chemistry dispensing step 144. Water may also be dispensed as a wetting step, similar to the wetting step 132 of FIG. 6, if useful for the residue being removed. The wetting step may also dispense the same or a different type of non-water, clean-out chemistry as used in the chemistry dispensing step 144.

Figure 8:
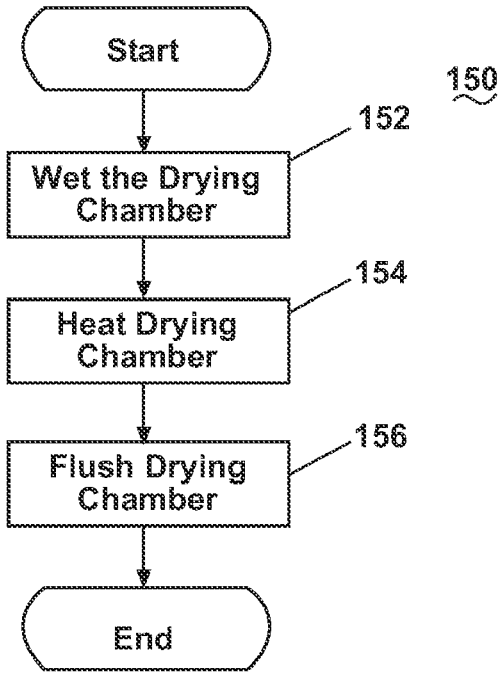
FIG. 8 is a flow chart illustrating an exemplary water and other chemistry clean-out cycle of operation to be carried out by any of the dispensing dryers of FIGS. 1-4.

FIG. 8 illustrates a third exemplary clean-out cycle 150, which uses both water and non-water clean-out chemistry. This method may be particularly suited when there is residual from multiple residual treating chemistries in the dispensing dryer 10 that may be both water soluble and water non-soluble.

The clean-out cycle 150 may begin with an initial wetting step 152, which may be done while rotating the drum 28. It should be noted that the initial wetting step is optional and may be excluded from the method. The initial wetting step may include either water or non-water chemistries or a mixture thereof. The water and non-water chemistry entering the drying chamber 34 dissolve any residual treating chemistry buildup therein to form a mixture. Water flowing through the dispensing system 51 may act to dispense the non-water clean-out chemistry.

The method may continue with a heating step 154 wherein the drying chamber 34 is heated to a predetermined reference temperature, which may be done while the drum 28 is rotated. The reference temperature may be an activation temperature for the non-water chemistry. It is preferred that the temperature not be great enough to vaporize the mixture. However, if it does, the air flow system may be run to remove the vapors before they redeposit. As the drying chamber 34 and mixture are heated, the remaining residual treating chemistry buildup still adhered to the inner surfaces of the dispensing dryer 10 should begin to dissolve and form part of the mixture. If the threshold temperature is met then heating may be stopped.

The heating step 154 is followed by a flushing step 156 during which either or both water or non-water clean-out chemistry may be dispensed into the drying chamber 34. The additional water or non-treating chemistry will function to both aid in dissolving any non-dissolved residue into the mixture and flushing the mixture from the drying chamber 34. If only flushing is desired, then water need only be dispensed during the flushing step 156. If it is contemplated that more treating chemistry residue needs dissolving, then water and/or non-water clean out chemistry may be dispensed. The clean out chemistry, if dispensed, may be selected based on the treating chemistry forming the residue.

The water and non-water clean-out chemistry may be dispensed while the drum 28 is rotated. Again, the water flowing through the reservoir 52 may act to dispense the other clean-out chemistry. Alternatively, the clean-out chemistry may be dispensed by the pump 64. This second dispensing into the drying chamber 34 will more effectively flush the dispensing system 51 and drying chamber 34. The dispensing may continue until a threshold amount has been dispensed. The threshold amount may be determined by the amount of time the water and other clean-out chemistry have been dispensed or by a volume determination. Separate determinations may be made for the amount of water dispensed and the amount of other chemistry dispensed. The threshold values may be empirically determined for each dispensing dryer 10.

When the appropriate amount of water and other clean-out chemistry are dispensed, the controller 44 closes the water supply valve 60, terminates power to the pump 64, and terminates power to the motor 48 and the clean-out cycle 150 terminates. The mixture of clean-out chemistry, water, and treating chemistry then may be wiped from the inner drum surfaces by the user or an accessory, or the mixture may be drained via the drain channel 68 and a drain pan 70 or the drain channel 68, drain pump 72, and drain pump outlet conduit 74.

Figure 9:
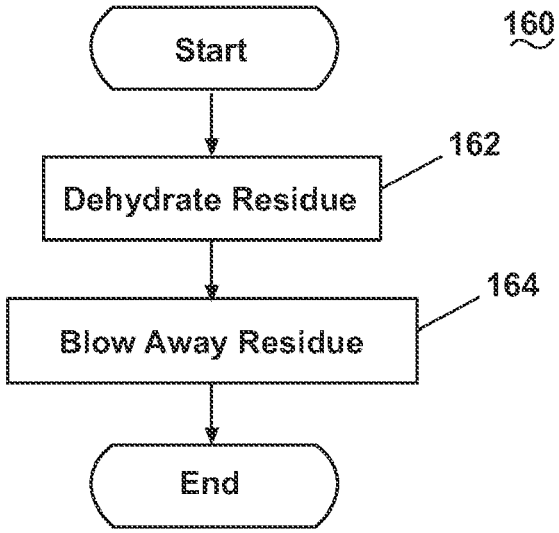
FIG. 9 is a flow chart illustrating an exemplary no water and no chemistry clean-out cycle of operation to be carried out by any of the dispensing dryers of FIGS. 1-4.

In some cases, residual treating chemistry buildup on the surfaces in the dispensing dryer 10 may break down into a powder or flakes if properly dehydrated. Thus, an associated cleanout cycle may occur without the introduction of clean-out chemistry. FIG. 9 illustrates a fourth exemplary clean-out cycle where no clean-out chemistry is dispensed into the dispensing system 51, which is referred to as the non-clean-out chemistry clean-out cycle 160. The non-clean-out chemistry clean-out cycle 160 may begin with a dehydration step 162. In the dehydration step 162, power may be provided to the heater assembly 40 to heat the drying chamber 34 to a reference temperature sufficient to ensure a thorough drying of the treating chemistry to form powder of flakes. The temperature of the drying chamber 34 may be held at the reference temperature for a predetermined period to ensure a thorough drying. When the dehydration step 162 is completed, the heating may be stopped.

A blowing step 164 may be started after the dehydration step 162. In the blowing step 164, the controller 44 provides power to the blower 36. Air is blown through the drying chamber 34 until a reference time is reached. The reference time may be empirically determined for each dispensing dryer 10 and may be the time necessary to dislodge the power or flakes and blow them either into a filter (not shown) or out of the exhaust conduit 42. When the reference time is reached, the controller 44 terminates power to the blower 36 and the non-water, non-clean-out chemistry clean-out cycle 160 terminates.

While the dehydration step 162 and blowing step are described as separate steps, they may be merged into one step by flowing air through the drying chamber during the entire cycle while heating may only take place part of the time. The constant flowing of air may speed up the dehydration process.

During the non-clean-out chemistry clean-out cycle 160, the air flow system may be operated at its maximum output to blow out as much of the powder and flakes as possible. The air flow may also be done in bursts to help dislodge the powder and flakes.

While shown as a stand-alone clean-out cycle, the non-clean-out chemistry clean-out cycle may be used with any other clean-out cycle. In many circumstances, it will be quite beneficial to first run the non-clean-out chemistry clean-out cycle 160 before or after running any of the other clean-out cycles that require the dispensing of liquids into the drying chamber 34.

Figure 10:
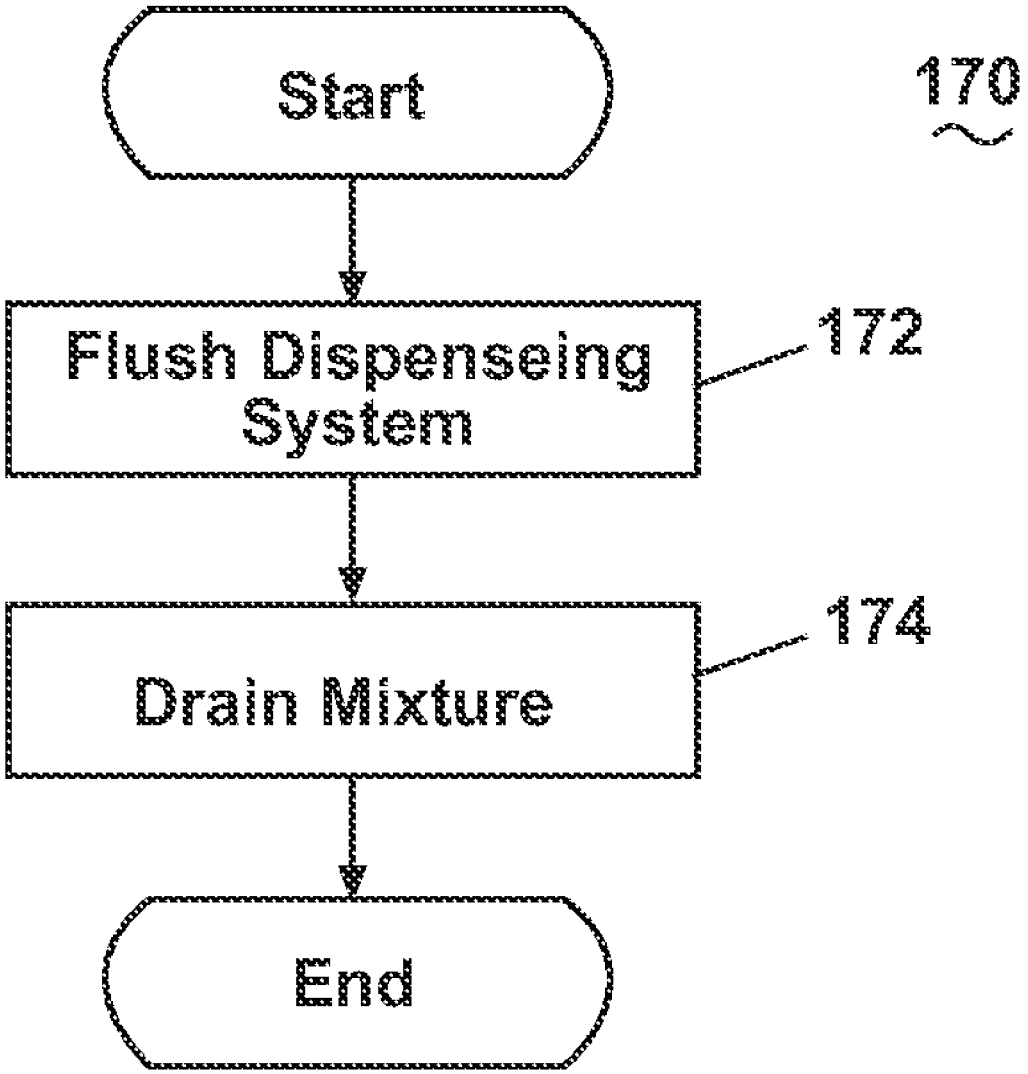
FIG. 10 is a flow chart illustrating an exemplary dispensing system only clean-out cycle of operation to be carried out by any of the dispensing dryers of FIGS. 1-4.

FIG. 10 illustrates a fifth exemplary clean-out cycle that includes cleaning out the dispensing system 51 independently of the drying chamber 34. The method for a dispensing system only clean-out cycle 170 may begin with a flushing step 172 wherein the dispensing system is flushed with water. That is the controller 44 may open the water supply valve 60 and water may enter the dispensing system 51 to be mixed with any residual treating chemistry therein to form a mixture. The method may continue with a draining step 174 where the mixture may be drained through the drying chamber 34 where it will then be drained via the drain channel 68 and a drain pan 70 or the drain channel 68, drain pump 72, and drain pump outlet conduit 74.

While the drum 38 may be rotated, there is no need to rotate the drum 28 as the dispensing system only clean-out cycle 170 is essentially only a line flush. Any residual mixture not drained may be wiped from the inner drum surfaces by the user or an accessory, or the mixture may be drained. If it is desired, the mixture may be drained before reaching the drying chamber 34. For example, the pump 64 may be fluidly connected to a second drain conduit 75 for connection to a drain line in a home plumbing system (not shown) for disposing of the chemistry and the controller 44 may operate the pump 64 to divert the mixture to the second drain conduit 75 instead of to the drying chamber 34. After the draining step 174 is complete, the dispensing system only clean-out cycle 170 terminates.

Treating chemistries may buildup in the dispensing system and drying chamber, which may negatively impact reliability and performance. For example, the buildup may negatively impact the ability of the dispensing system to properly dispense the treating chemistry. Also, not all of the treating chemistries are compatible and, when mixed, may impact the efficacy of the treating chemistries. Thus, residue from one of the chemistries may negatively impact the performance of the currently dispensed chemistry. All of the clean-out cycles described above help to cleanout the dispensing dryer 10 and avoid these negative consequences.

While the invention has been specifically described in connection with certain specific embodiments thereof, it may be understood that this is by way of illustration and not of limitation, and the scope of the appended claims should be construed as broadly as the prior art will permit.

What is claimed is:

1. A method of operating a laundry dryer comprising a rotatable drum at least partially defining a drying chamber for drying laundry, an airflow system fluidly coupled to the drying chamber for flowing air through the drying chamber, a heater for heating the air in the airflow system, a dispensing system fluidly coupled to the drying chamber for dispensing a treating chemistry into the drying chamber, a controller operably coupling the rotatable drum, airflow system, heater, and dispensing system, to selectively control their operation to implement a drying cycle stored in the controller to dry the laundry, the method comprising:

dispensing a treating chemistry into the drying chamber to treat the laundry; and executing a clean-out cycle to remove the treating chemistry from the drying chamber after the removal of the laundry from the drying chamber.

2. The method according to claim 1, wherein the dispensing is implemented as part of the drying cycle.

3. The method according to claim 2, wherein the executing of the clean-out cycle is executed after completion of the drying cycle.

4. The method according to claim 1, wherein the dispensing is part of a treating cycle separate from the drying cycle.

5. The method according to claim 4, wherein the executing of the clean-out cycle is executed after completion of the drying cycle.

6. The method according to claim 5, wherein the executing of the clean-out cycle is executed after the removal of the laundry from the drying chamber.

7. The method according to claim 1, further comprising determining which clean-out cycle to execute from a plurality of clean-out cycles stored in the controller.

8. The method according to claim 7, wherein the determination of which clean-out cycle to execute comprises determining at least one previously dispensed treating chemistry.

9. The method according to claim 7, wherein the determination of which clean-out cycle to execute comprises determining at least one previously executed drying cycle.

10. The method according to claim 1, wherein the executing the clean-out cycle further comprises removing the treating chemistry from the dispensing system.

11. The method according to claim 1, wherein the executing the clean-out cycle comprises at least one of: flowing air through the drying chamber; heating the drying chamber; rotating the drying chamber; dispensing clean-out chemistry into the drying chamber; and wiping the drying chamber.

12. The method according to claim 1, wherein the executing the clean-out cycle comprises flowing air through the drying chamber to remove particulates from the drying chamber.

13. The method according to claim 12, wherein the flowing of air comprises pulsing the flow of air through the drying chamber.

14. The method according to claim 12, wherein the flowing of air is a first action in the clean-out cycle.

15. The method according to claim 12, wherein the flowing of air comprises flowing air at the maximum flow rate of the airflow system.

16. The method according to claim 15, wherein the flowing of air comprises pulsing the flow of air through the drying chamber.

17. The method according to claim 1, wherein the executing the clean-out cycle comprises dispensing a clean-out chemistry from the dispensing system into the drying chamber to form a mixture of the clean-out chemistry and the treating chemistry.

18. The method according to claim 17, wherein the executing the clean-out cycle further comprises removing the mixture from the drying chamber.

19. The method according to claim 18, wherein the removing the mixture comprises wiping the mixture from the drying chamber.

20. The method according to claim 19, wherein the wiping the mixture from the drying chamber comprises using an accessory inside the dryer to wipe the inside of the drying chamber.

21. The method according to claim 19, wherein the removing the mixture comprises draining the mixture from the drying chamber.

22. The method according to claim 18, wherein the executing the clean-out cycle further comprises heating the drying chamber to evaporate the mixture.

23. The method according to claim 22, wherein the executing the clean-out cycle further comprises flowing air through the drying chamber to remove the evaporated mixture.

24. The method according to claim 17, wherein the executing the clean-out cycle further comprises rotating the drum.

25. The method according to claim 24, wherein the drum is rotated during dispensing of the clean-out chemistry.

26. The method according to claim 17, wherein the executing the clean-out cycle further comprises heating the drying chamber.

27. The method according to claim 26, wherein the drying chamber is heated to a functional temperature for the clean-out chemistry.

28. The method according to claim 1, wherein the executing the clean-out cycle comprises cleaning out the dispensing system independently of the drying chamber.

29. The method according to claim 28, wherein the cleaning out the dispensing system comprises dispensing water through the dispensing system.

30. The method according to claim 1, wherein the executing the clean-out cycle comprises:

dispensing clean-out chemistry into the drying chamber while rotating the drum without flowing air through the drying chamber and without heating the drying chamber; and flowing air through the drying chamber and heating the drying chamber after the dispensing of the clean-out chemistry while rotating the drum.

31. The method according to claim 30, wherein the executing the clean-out cycle further comprises dispensing water into the drying chamber after the drying chamber reaches a predetermined temperature.

32. The method according to claim 31, wherein the executing the clean-out cycle further comprises removing a mixture of the clean-out chemistry, water, and treating chemistry from the drying chamber.

33. The method according to claim 32, wherein the removing the mixture comprises wiping the drying chamber.

34. The method according to claim 33, wherein the wiping the drying chamber comprises using an accessory inside the dryer to wipe the inside of the drying chamber.

35. The method according to claim 1, wherein the executing the clean-out cycle comprises flowing air through the drying chamber while heating the drying chamber to a predetermined temperature.

36. The method according to claim 35, wherein the flowing of air comprises pulsing bursts of air through the drying chamber.

37. The method according to claim 35, wherein the flowing of air comprises flowing air at the maximum flow rate of the airflow system.

38. The method according to claim 37, wherein the flowing of air comprises pulsing bursts of air through the drying chamber.

39. The method according to claim 35, wherein the executing the clean-out cycle further comprises cleaning a lint filter in the airflow system.

40. A method of operating a laundry dryer comprising a rotatable drum at least partially defining a drying chamber for drying laundry, an airflow system fluidly coupled to the drying chamber for flowing air through the drying chamber, a heater for heating the air in the airflow system, a dispensing system fluidly coupled to the drying chamber for dispensing a treating chemistry into the drying chamber, a controller operably coupling the rotatable drum, airflow system, heater, and dispensing system, to selectively control their operation to implement a drying cycle stored in the controller to dry the laundry, the method comprising:

dispensing a liquid treating chemistry into the drying chamber to treat the laundry;

drying the laundry in the drying chamber by supplying heated air into the drying chamber to evaporate the liquid treating chemistry from the laundry; and executing a clean-out cycle to remove the treating chemistry from the drying chamber.

41. A method of operating a laundry dryer comprising a rotatable drum at least partially defining a drying chamber for drying laundry, an airflow system fluidly coupled to the drying chamber for flowing air through the drying chamber, a heater for heating the air in the airflow system, a dispensing system fluidly coupled to the drying chamber for dispensing a treating chemistry into the drying chamber, a controller operably coupling the rotatable drum, airflow system, heater, and dispensing system, to selectively control their operation to implement a drying cycle stored in the controller to dry the laundry, the method comprising:

dispensing a liquid treating chemistry into the drying chamber to treat the laundry;

drying the laundry in the drying chamber by supplying heated air into the drying chamber to evaporate the liquid treating chemistry from dehydrate the laundry; and executing a clean-out cycle to remove the treating chemistry from the drying chamber after the removal of the laundry from the drying chamber.

* * * * *